US011730258B2

(12) United States Patent
Guthrie et al.

(10) Patent No.: US 11,730,258 B2
(45) Date of Patent: Aug. 22, 2023

(54) TOILET BRUSH

(71) Applicants: Kevin J. Guthrie, Wind Lake, WI (US); Jordan Smith, Waukesha, WI (US)

(72) Inventors: Kevin J. Guthrie, Wind Lake, WI (US); Jordan Smith, Waukesha, WI (US)

( * ) Notice: Subject to any disclaimer, the term of this patent is extended or adjusted under 35 U.S.C. 154(b) by 204 days.

(21) Appl. No.: 17/211,110

(22) Filed: Mar. 24, 2021

(65) Prior Publication Data

US 2021/0298465 A1 Sep. 30, 2021

Related U.S. Application Data

(60) Provisional application No. 62/994,062, filed on Mar. 24, 2020.

(51) Int. Cl.

| | |
|---|---|
| ***A46B 5/00*** | (2006.01) |
| ***A46B 15/00*** | (2006.01) |
| ***A47K 17/00*** | (2006.01) |
| ***A46B 9/02*** | (2006.01) |

(52) U.S. Cl.

CPC ..... *A46B 5/0095* (2013.01); *A46B 5/0029* (2013.01); *A46B 9/026* (2013.01); *A46B 15/0051* (2013.01); *A46B 15/0081* (2013.01); *A47K 17/00* (2013.01); *A46B 2200/3033* (2013.01)

(58) Field of Classification Search

CPC ..... A46B 5/0095; A46B 5/0029; A46B 9/026; A46B 9/005; A46B 15/0051; A46B 15/0081; A46B 2200/3033; A46B 2200/304; A46B 2200/3006; A46B 3/04; A46B 3/20; A46B 7/042; A46B 2200/3013; A46B 3/005; A46B 3/22; A46B 1/00; A46D 1/0207; A47K 17/00; A47K 11/10; A47K 7/028; A47L 17/06

USPC ..... 15/111, 188, 187

See application file for complete search history.

(56) References Cited

U.S. PATENT DOCUMENTS

| | | | | | |
|---|---|---|---|---|---|
| 6,154,913 | A * | 12/2000 | Burton | A46B 5/0095 | 403/220 |
| 7,386,910 | B2 * | 6/2008 | Minkler | A47L 13/16 | 15/210.1 |
| 2007/0089224 | A1 * | 4/2007 | Wildauer | E03C 1/308 | 4/255.11 |
| 2009/0106922 | A1 * | 4/2009 | Groendahl | A47K 11/10 | 15/160 |
| 2011/0225751 | A1 * | 9/2011 | Chapman | A46B 15/0055 | 15/114 |
| 2014/0331425 | A1 * | 11/2014 | Baker | A47K 11/10 | 15/114 |
| 2016/0331194 | A1 * | 11/2016 | Stewart | A47K 11/10 | |
| 2017/0119227 | A1 * | 5/2017 | Chaffee | B25G 3/16 | |

FOREIGN PATENT DOCUMENTS

| | | | | |
|---|---|---|---|---|
| WO | WO-0071012 A1 * | 11/2000 | | A47K 11/10 |

* cited by examiner

*Primary Examiner* — Orlando E Aviles
*Assistant Examiner* — Jacob Adam Montgomery
(74) *Attorney, Agent, or Firm* — Amundsen Davis, LLC; Joseph S. Heino; Erin E. Kaprelian

(57) ABSTRACT

A toilet brush comprises a handle and a brush head. A backbone core is coupled to the handle. An inner support piece is further coupled to the backbone core and to the brush head. The handle further comprises an attachment area and the brush head further includes a scraping feature.

6 Claims, 5 Drawing Sheets

TOILET BRUSH

PRIORITY CLAIM

This application claims priority to U.S. Provisional Patent Application 62/994,062, filed Mar. 24, 2020, the contents of which are hereby incorporated by reference.

BACKGROUND OF THE INVENTION

Toilets are a ubiquitous feature of homes, businesses, and indeed, general life. Due to the ongoing nature of their use, it is important to regularly clean the various components of the toilet. This includes cleaning the tank and other external features, as well as cleaning the toilet bowl.

DETAILED DESCRIPTION

Figure 1:
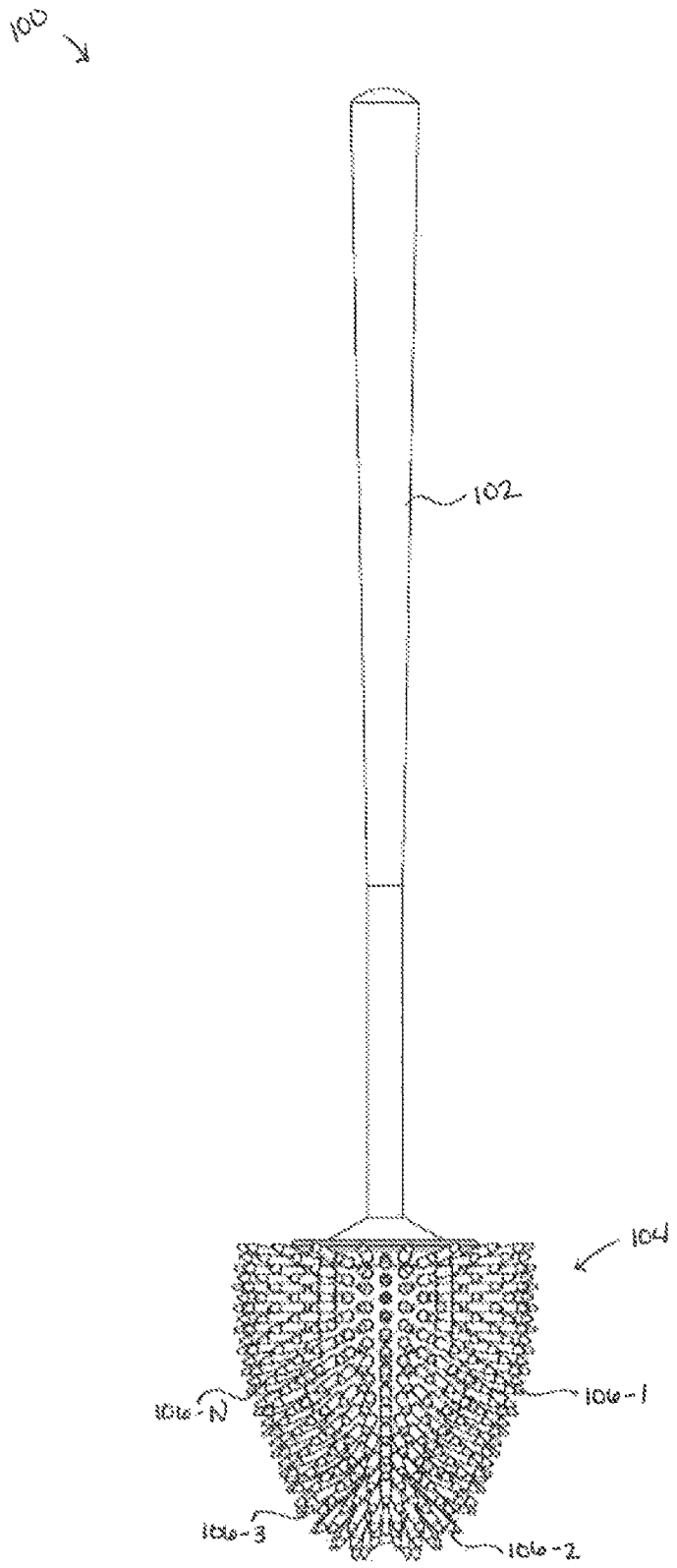
FIG. 1 is an example of a toilet brush consistent with the present disclosure.

Toilets are found throughout everyday life, be it in homes or in businesses. A toilet is generally comprised of two main components: a toilet tank and a toilet bowl, with additional components disposed within the toilet setup. The toilet tank and toilet bowl are commonly made from china or porcelain, although other materials may be used.

In addition to plumbing-related maintenance of a toilet, one important piece of toilet maintenance is regular cleaning. Cleaning of a toilet may be accomplished in multiple ways. For example, the external parts of a toilet may be cleaned using wipes that contain cleaning solution, by using a sponge and a cleanser, or by any other method. To clean the internal parts, and in particular the toilet bowl, however, the options become more limited. Although a person can use a sponge or wipes, they are not suited for cleaning below the waterline of the toilet bowl. As a result, the toilet bowl may not be fully cleaned. In addition, due to the presence of germs and such within the toilet bowl, and particularly those below the waterline, it is often desirable to clean the toilet bowl while still having one's hands a safe distance away.

To that end, a toilet brush is often used to clean toilet bowls. As used herein, a "toilet brush" refers to a device having a head disposed on a handle. In its typical use and storage positions, the handle extends upwardly away from the head so that a person is able to maintain some distance from the surface of the water in the toilet bowl during cleaning. The head, meanwhile, contains protrusions, often bristles, that can be used to scrub within the bowl of the toilet.

Many toilet brushes are made primarily of plastic, with the handle and the body of the head being made thereof. Many toilet brushes further contain bristles integrated into the body of the head and extending outwardly therefrom. These bristles are often made of synthetic plastic material such that they are relatively rigid (i.e., do not "droop") but are still able to move with respect to the toilet bowl when the toilet brush is being used. In some examples, the bristles are disposed evenly around the head of the toilet brush; in other examples, the bristles are disposed in clusters, such that the head has areas with high concentrations of bristles and areas with low concentrations of bristles, or no bristles at all.

One shortcoming in having an all-plastic toilet brush, as most toilet brushes are, is the inherent rigidity of the material. Toilet bowls have many irregularly shaped surfaces, from the area under the rim to the area where the water drains when the toilet is flushed, and a rigid plastic toilet brush may not be able to completely access these areas for cleaning. As a result, some areas of the toilet bowl are not reached by the bristles and are not fully cleaned, which defeats the purpose of cleaning the toilet bowl in the first place.

In addition, the use of synthetic bristles also presents concerns, particularly with regards to cleanliness. Because synthetic bristles are very thin, and may be densely packed, it can be difficult to disinfect the head of the toilet brush sufficiently, with the result that particles of fecal matter, and other bacteria and viruses, may remain on the bristles long after the toilet bowl has been cleaned. As a consequence, these particulates may be reintroduced into the toilet bowl on subsequent cleanings.

A toilet brush consistent with the present disclosure, by contrast, is designed to have at least a portion of the head be pliable to allow for easy access to all surfaces, both regular and irregular, of the inside surfaces of a toilet bowl. A core portion of the head may be manufactured of a rigid material, such as plastic; this core feature may then be coupled with a foam core. The foam core is able to deform to clean irregular surfaces in a toilet, while still remaining rigid enough to hold its shape while not in use. In addition, the outer portion of the brush head may be made of a material having a pliable durometer, further allowing for deformation and accessibility to crevices within the toilet bowl. Moreover, the bristles of the brush head may be manufactured from the same material, and may be larger in diameter than typical synthetic bristles. In addition, the bristles may be disposed such that, when the head is pressed against a surface of the toilet bowl, a larger footprint is available for cleaning.

FIG. 1 is an example of a toilet brush 100 consistent with the present disclosure. Toilet brush 100 includes a handle 102. Handle 102 may be cylindrical, as shown in FIG. 1, although examples are not so limited and other shapes may be used. In some examples, handle 102 may have a consistent diameter throughout its length; in other examples, handle 102 may have a larger diameter near the top, where a user would grasp the handle, and have a diameter that decreases through the length. Handle 102 may be made of plastic, metal, hard rubber, or any other rigid material.

A brush head 104 is disposed at an end of handle 102. As shown in FIG. 1, brush head 104 may be substantially conical in shape; that is, brush head 104 may have a top portion having a first diameter and a bottom portion having a second diameter that is less than the first diameter, with the sides of the brush head 104 tapering between the top portion and the bottom portion. However, examples are not so limited, and brush head 104 may be any other shape. Brush head 104 may include a plurality of bristles 106-1, 106-2, 106-3 . . . 106-N (collectively, bristles 106). Bristles 106 are disposed around the entire surface of brush head 104 and extend outwardly therefrom, such that each individual bristle 106 is disposed perpendicular to the surface of brush head 104. Brush head 104, as well as bristles 106, may be made of rubber, silicon, thermoplastic elastomer (TPE), polyvinyl chloride (PVC), or any other material having a suitable soft and pliable durometer. In some examples, the brush head 104 and/or bristles 106 may be further treated with a solution to provide additional protection for the material, particularly against cleaning agents as well as water. This may aid in prolonging the life of the toilet brush 100. The solution may be non-sticking, hydrophobic, antimicrobial, any combination thereof, or any other solution that may protect the material.

Figure 2:
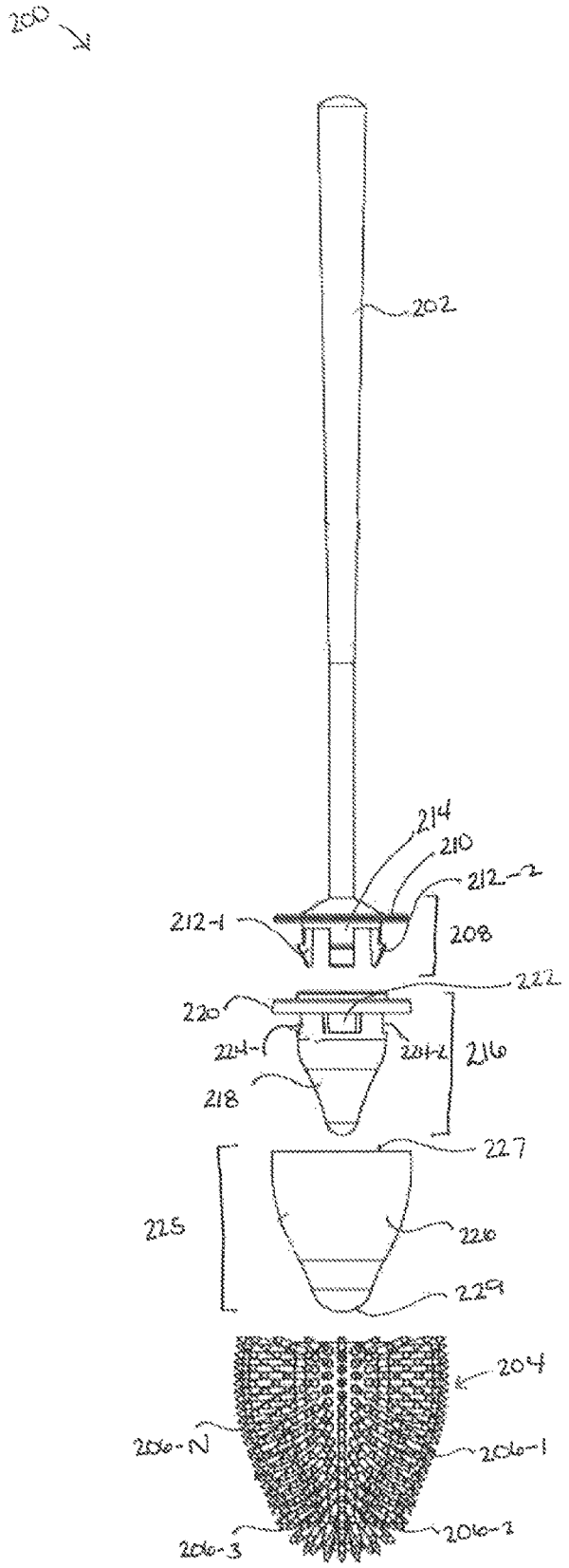
FIG. 2 is an example of a toilet brush, shown with the components exploded, consistent with the present disclosure.

FIG. 2 is an example of a toilet brush 200, shown with the components exploded, consistent with the present disclosure. Toilet brush 200 includes a handle 202 and a brush head 204; brush head 204 further comprises a plurality of bristles 206-1, 206-2, 206-3 . . . 206-N (collectively bristles 206). Handle 202, brush head 204, and bristles 206 are akin to handle 102, brush head 104, and bristles 106, discussed with respect to FIG. 1.

Brush handle 202 includes an attachment area 208 disposed at a proximal end of the handle 202. Attachment area 208 includes a capturing flange 210. As used herein, a flange refers to a projecting collar or flat rim that attaches, or strengthens and attachment between components. A capturing flange, such as capturing flange 210, is a flange that couples to, or "captures", a component, such as a seal. The interaction between capturing flange 210 and other components of toilet brush 200 are discussed further herein with respect to FIG. 5.

A plurality of snap features 212-1, 212-2 (collectively snap features 212) are disposed underneath capturing flange 210. Although two snap features 212 are shown in FIG. 2, examples are not so limited, and any number of snap features may be used. Snap features 212 may be disposed such that they are perpendicular with respect to the capturing flange 210. Said differently, snap features 212 may extend downwardly from the capturing flange 210, with the "snap" portion of snap features 212 being located proximal to the capturing flange 210.

A central fastener 214 may be disposed between the plurality of snap features 212. Central fastener 214 may extend perpendicularly downward with respect to capturing flange 210, similar to snaps 212. As shown in FIG. 2, central fastener 214 may be larger in size than snap features 212, although examples are not so limited and central fastener 214 may be smaller than, or the same size as, snap features 212.

Toilet brush 200 further comprises a backbone core 216. Backbone core 216 includes a core body 218. Core body 218 may have a generally conical shape, as shown in FIG. 2, although examples are not so limited and other shapes may be used. Core body 218 may be made of plastic or any other suitably rigid material, as backbone core 216 provides support to the remainder of brush head 204.

Disposed at an upper portion of core body 218 may be a seal lip 220. As used herein, a "seal lip" refers to a portion of the backbone core 216 extending past the diameter of the core body 218 which is used as a contact point between the backbone core 216 and the handle 202. More particularly, seal lip 220 may, when joined with handle 202, prevent substances, including cleaning agents and water, from passing through and into the interior of handle 202. The particular coupling of handle 202 with seal lip 220 is discussed further herein with respect to FIGS. 4 and 5.

Core body 218 may further include a central opening 222. Central opening 222 may be disposed beneath seal lip 220 and may be sized to receive central fastener 214. Central fastener 214 may couple to backbone core 216 by a snap fit, a press fit, use of adhesive, spin weld, or any other suitable fastening method that allows a secure fit.

In addition, core body 218 may include a plurality of couplings 224-1, 224-2 (collectively, couplings 224). Couplings 224 may be shaped and sized to mate with snap features 212. Snap features 212 may connect with couplings 224 by a snap fit, where a portion of a snap feature 212 "locks" into a corresponding feature of a coupling 224. However, examples are not so limited, and couplings 224 may mate with snap features 212 using threaded fasteners, a press fit, adhesive, spin welding, ultrasonic welding, hotplate welding, or any other suitable fastening method. Combined, central opening 222 and couplings 224 may be the locations at which handle 202 is coupled to backbone core 216.

Toilet brush 200 further includes an inner support piece 225. Inner support piece 225 may include an upper opening 227, a tip portion 229, and a body 226 disposed between the upper opening 227 and tip portion 229. As shown in FIG. 2, inner support piece 225 may be generally conical in shape; that is, upper opening 227 may be greater in diameter than tip portion 229, with body 226 having a tapered or decreasing diameter between the two. Examples are not so limited, however, and any similar shape may be used. Importantly, however, inner support piece 225 must be substantially the same shape as that of the backbone core 216. This is because inner support piece 225 may couple to backbone core 216. Inner support piece 225 may be made of open cell foam, closed cell foam, hybrid cell foam, or any other suitably pliable material.

Inner support piece 225 may be substantially hollow in nature. That is, inner support piece 225 may be open at upper opening 227, but closed at tip portion 229; body 226 meanwhile, may not be solid but may instead comprise an outer wall, leaving an inner portion of inner support piece 225 open or hollow. As discussed above, inner support piece 225 may couple to backbone core 216. More particularly, inner support piece 225 may receive backbone core 216 within the hollow portion. Backbone core 216 may couple to inner support piece 225 using a press fit, a friction fit, an adhesive fit, or any other suitable coupling means.

Inner support piece 225 may further couple to brush head 204. Brush head 204 may be similarly substantially hollow, having an opening at the top and a body wall that is of sufficient thickness to support bristles 206 but not so thick as to preclude coupling with inner support piece 225. As with the coupling between backbone core 216 and inner support piece 225, brush head 204 may receive inner support piece 225 within the hollow. A press fit, friction fit, adhesive, or any other securement means may be used to secure inner support piece 225 within brush head 204. Importantly, however, the securement means must not affect the pliability of the foam material making up inner support piece 225. This is because inner support piece 225 is designed to deform, or absorb the features of the toilet, when the brush head 204 is pressed against a toilet surface, allowing a greater surface area of the brush head 204 to be in contact with the toilet surface, as well as allowing brush head 204 to access crevices and irregularly shaped areas within the toilet such as jetted key holes and other intended and developed surfaces common in more modern toilet bowl constructs.

Figure 3:
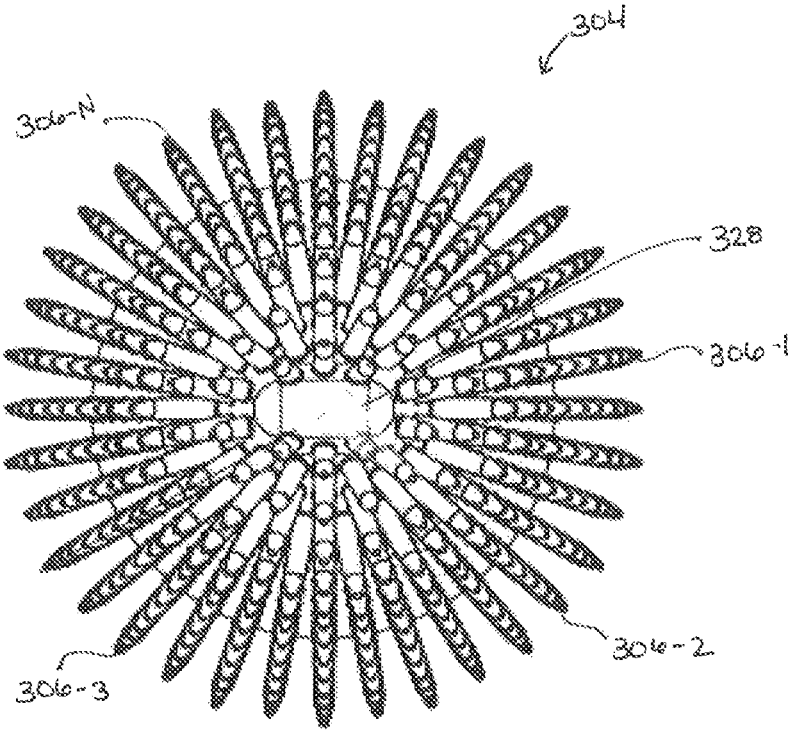
FIG. 3 is an example of the tip of the head of a toilet brush consistent with the present disclosure.

FIG. 3 is an example of the tip of the head 304 of a toilet brush consistent with the present disclosure. Head 304 includes a plurality of bristles 306-1, 306-2, 306-3 . . . 306-N (collectively, bristles 306), which may be akin to bristles 106 and bristles 206, discussed with respect to FIGS. 1 and 2.

The bottommost portion of head 304 may include a scraping feature 328. As used herein, a "scraping feature" refers to a bristle-less portion that is designed to scrape or brush areas that may require additional detail or be dirtier than other areas. Scraping feature 328 may be made of the same material as the head 304, or may be made of a harder material, such as plastic.

Figure 4:
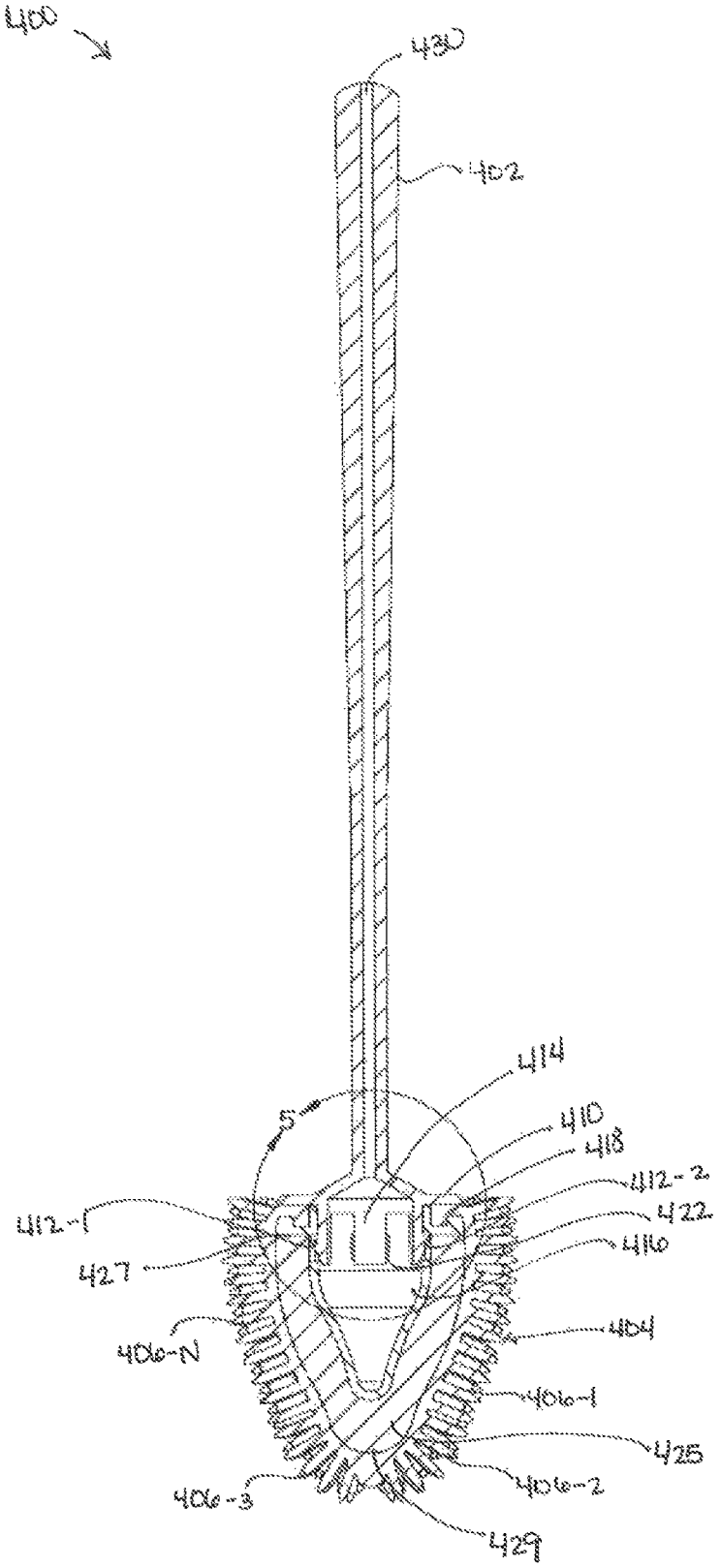
FIG. 4 is a cutaway view of a toilet brush consistent with the present disclosure.

FIG. 4 is a cutaway view of a toilet brush 400 consistent with the present disclosure. Toilet brush includes a handle 402 and a brush head 404; brush head 404 includes a plurality of bristles 406-1, 406-2, 406-3 . . . 406-N (collectively, bristles 406).

In some examples, handle 402 may include a vent 430. As used herein, a "vent" refers to an opening to allow release of air from within a system. Vent 430 may be disposed along the length of handle 402, although examples are not so limited. In some examples vent 430 may serve to allow the foam making up the inner support piece 425 to "breathe". Said differently, the vent 430 may allow airflow within the toilet brush 400 so that the foam inner support piece 425 is able to fully expand and collapse.

As shown in FIG. 4, handle 402 is coupled to brush head 404, with the internal components of brush head 404 being coupled together to provide a cohesive toilet brush 400. When toilet brush 400 is assembled, capturing flange 410 rests on brush head 404 and seal lip 418. Central fastener 414 is captured within the central opening 422 and snaps 412-1, 412-2 (collectively, snaps 412) are captured within couplings (discussed with respect to FIG. 2). As discussed with respect to FIG. 2, central fastener 414 and the couplings to receive snaps 412 are part of backbone core 416; thus, it is apparent that the handle is coupled to the backbone core 416.

Backbone core 416, in turn, is coupled to inner support piece 425. As shown in FIG. 4, backbone core 416 is disposed within a hollow portion of inner support piece 425; that is, inner support piece 425 receives backbone core 416 within its structure. As discussed with respect to FIG. 2, inner support piece 425 may have an upper opening 427 and a tip 429, which may be closed. Backbone core 416 may be inserted into upper opening 427 and extend downwardly towards tip 429. Inner support piece 425 may then be coupled to brush head 404, as discussed with respect to FIG. 2.

Figure 5:
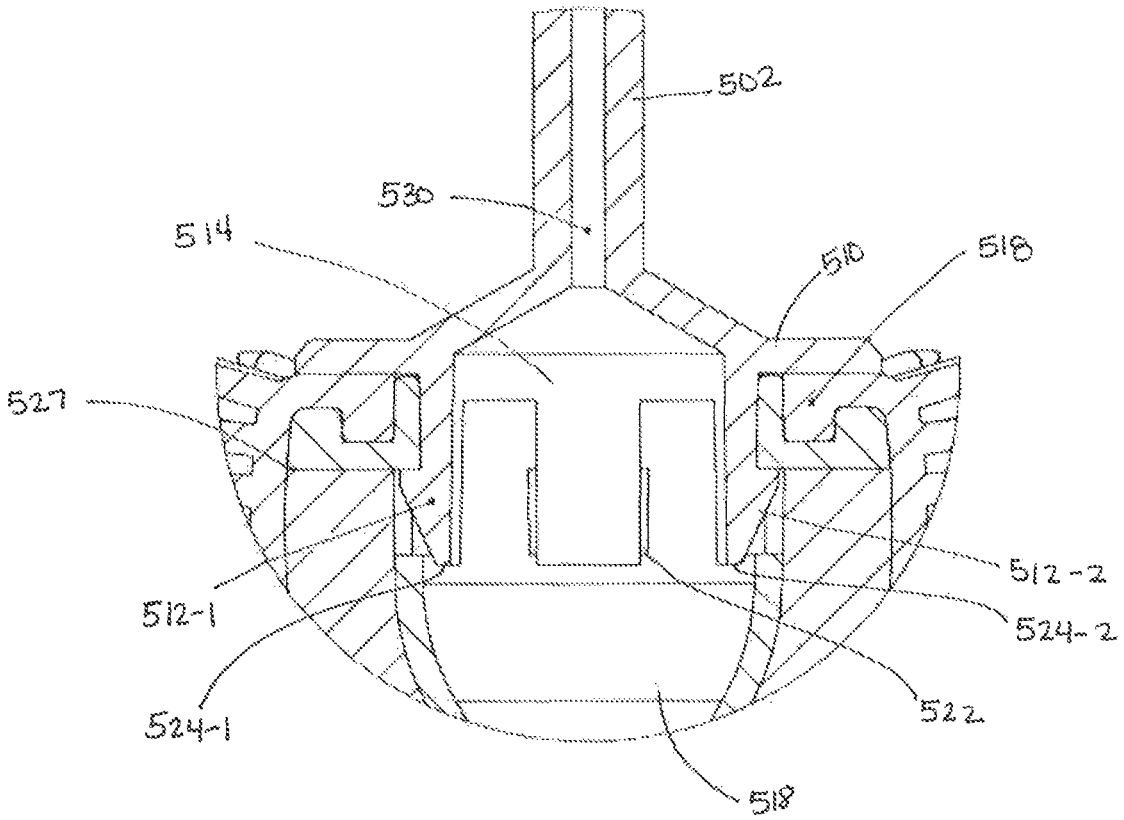
FIG. 5 is a detail view of the toilet brush shown in FIG. 4, taken along line 5.

FIG. 5 is a detail view of the toilet brush shown in FIG. 4, taken along line 5. More particularly, FIG. 5 shows the connection points and coupling between the handle 502 and the backbone core (a portion of the core body 518 of the backbone core is shown in FIG. 5). As shown in FIG. 5, capturing flange 510, disposed at a proximal end of handle 502, forms an upper boundary for the toilet brush head when assembled. Central fastener 514, which is integral to handle 502, extends downwardly from capturing flange 510 and is coupled to central opening 522. In addition, snap features 512-1, 512-2 (collectively, snap features 512), also extending downwardly from capturing flange 510, interact with couplings 524-1, 524-2 (collectively, couplings 524). As can be seen in FIG. 5, snap features 512 may include an extended portion or ledge that may further interact with a portion of the backbone core; more specifically, snap features 512 may interact with both the couplings 524 and with seal lip 518. In addition, seal lip 518 may be urged downward, or held in place, by coupling flange 510, thus providing a watertight seal. Air may still access the toilet brush head through handle vent hole 530; however, as described with respect to FIG. 4, the handle vent hole 530 may only extend through the handle (i.e., it may not permit water or other substances to enter the handle and make their way to the brush head).

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. A toilet brush, comprising:
- a handle comprising an attachment area; and
- the attachment area further comprising:
  - a capturing flange disposed at a proximal end of the handle;
  - a plurality of snap features disposed underneath and perpendicular with respect to the capturing flange; and
  - a central fastener disposed between the plurality of snap features, wherein the central fastener extends perpendicularly downward from the capturing flange;
- a hollow brush head having a top, a body wall extending downwardly from the top and a plurality of bristles that are integrally formed as part of the body wall, the plurality of bristles extending outwardly from the body wall and disposed between the top of the brush head to a bottom of the brush head, the top of the brush head having an opening;
- a backbone core coupled to the handle, the backbone core further comprising:
  - a core body;
  - a seal lip;
  - a central opening to receive the central fastener; and
  - a plurality of couplings to mate with the plurality of the snap features; and
- a support piece coupled to the backbone core and disposed wholly within the hollow brush head and extending from the top opening of the hollow brush head to the bottom of the hollow brush head.

2. The toilet brush of claim 1, further comprising a scraping feature disposed at a tip of the brush head, the tip and the scraping feature being disposed at the bottom of the hollow brush head.

3. The toilet brush of claim 1, wherein the handle further comprises a vent disposed along a length of the handle.

4. The toilet brush of claim 1, wherein the handle couples to the backbone core at the central opening and the plurality of couplings.

5. The toilet brush of claim 1, wherein the support piece further comprises:
- an upper opening;
- a tip portion; and a body disposed between the upper opening and the tip portion.

6. The toilet brush of claim 5, wherein:

the support piece comprises a hollow portion; and the support piece receives the backbone core within the hollow portion.

* * * * *